US009069306B2

(12) United States Patent
Suzuki et al.

(10) Patent No.: US 9,069,306 B2
(45) Date of Patent: Jun. 30, 2015

(54) FIXING DEVICE

(71) Applicants: Noboru Suzuki, Komaki (JP); Kei Ishida, Nagoya (JP); Takuji Matsuno, Ichinomiya (JP); Yoshihiro Miyauchi, Ama (JP)

(72) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 34 days.

(21) Appl. No.: 13/623,413

(22) Filed: Sep. 20, 2012

(65) Prior Publication Data

US 2013/0071159 A1 Mar. 21, 2013

(30) Foreign Application Priority Data

Sep. 20, 2011 (JP) ..... 2011-205133

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2064; G03G 15/2067; G03G 2215/2016; G03G 2215/2032
USPC ..... 399/329
See application file for complete search history.

(56) References Cited

U.S. PATENT DOCUMENTS

2009/0110448 A1* 4/2009 Hiraoka et al. ..... 399/328
2011/0222875 A1* 9/2011 Imada et al. ..... 399/33

FOREIGN PATENT DOCUMENTS

JP 10181937 A 7/1998

* cited by examiner

*Primary Examiner* — David Bolduc
*Assistant Examiner* — Barnabas Fekete
(74) *Attorney, Agent, or Firm* — Banner & Witcoff, Ltd.

(57) ABSTRACT

A fixing device may include first and second fixing members arranged to form a nip portion, an urging member that provides an urging force to urge the first fixing member toward the second fixing member, a change member configured to change a width of the nip portion from a first nip width to a second nip width by applying a pressing force to the first fixing member against the urging force of the urging member and change the width of the nip portion from the second nip width to the first nip width by releasing the pressing force, and a restriction portion configured to restrict movement of the first fixing member and restrict a maximum value of the first nip width of the nip portion while the pressing force against the urging force is released.

7 Claims, 13 Drawing Sheets

FIXING DEVICE

CROSS REFERENCE TO RELATED APPLICATION

This application claims priority to Japanese Patent Application JP2011-205133, filed Sep. 20, 2011, whose contents are expressly incorporated herein by reference in its entirety.

TECHNICAL FIELD

Aspects described herein relate to a fixing device that may be configured to fix an image onto a recording sheet.

BACKGROUND

There is known a fixing device including a heat member that applies heat to a recording sheet, a pressure roller that forms a nip portion between the pressure roller and the heat member, an urging mechanism that urges the heat member to the pressure roller, and a change member that changes the width of the nip portion by applying a pressing force to the heat member against an urging force of the urging mechanism. With this technique, the change member can change the width of the nip portion to a first nip width for thermal fixing or a second nip width (0) for jamming processing. The second nip width is smaller than the first nip width.

With this technique, the urging mechanism has a structure including an arm member that can swing while supporting the heat member, and an urging member that urges the heat member to the pressure roller through the arm member. The change member includes a cam that presses the arm member against an urging force of the urging member. Additionally, when the cam is released from the arm member, and hence the movement of the arm member is no longer restricted by the other member such as the cam, the entire urging force of the urging member is applied to the pressure roller. As a result, the width of the nip portion becomes the first nip width. When the cam presses the arm member against the urging force and receives the urging force, the width of the nip portion becomes the second nip width.

However, with the technique of the related art, for example, if the hardness of the pressure roller changes with use, e.g., due to the pressure roller receiving an entire urging force when the width of the nip portion is the first nip width, the nip width may become a nip width larger than the maximum value of an allowable range for the first nip width. In this case, proper fixing performance may not be achieved.

SUMMARY

Aspects described herein relate to a fixing device including first and second fixing members arranged and/or configured to form a nip portion, an urging mechanism having an urging member configured to provide an urging force and to urge the first fixing member to the second fixing member, a change member configured to change a width of the nip portion from a first nip width to a second nip width smaller than the first nip width by applying a pressing force to the first fixing member against the urging force of the urging member. The change member may further be configured to change the width of the nip portion from the second nip width to the first nip width by releasing the pressing force. The fixing device may also include a restriction portion configured to restrict movement of the first fixing member and to determine a maximum value of the first nip width of the nip portion while the pressing force against the urging force is released.

According to other aspects, the fixing device may further include a flexible cylindrical member having an inner peripheral surface. The first and second fixing members may be configured and/or arranged to pinch the cylindrical member and form the nip portion.

DETAILED DESCRIPTION

An embodiment is described below in detail with reference to the figures. The general configuration of an example laser printer 1 (an image forming apparatus) including a fixing device 100 according to an embodiment is briefly described, followed by further description of the fixing device 100.

The following description applies directions with reference to a user of the laser printer 1. In particular, it is assumed that the right side in FIG. 1 is "front," the left side is "rear," the near side is "left," and the deep side is "right." Also, it is assumed that the up-down direction in FIG. 1 is "up and down."

Figure 1:
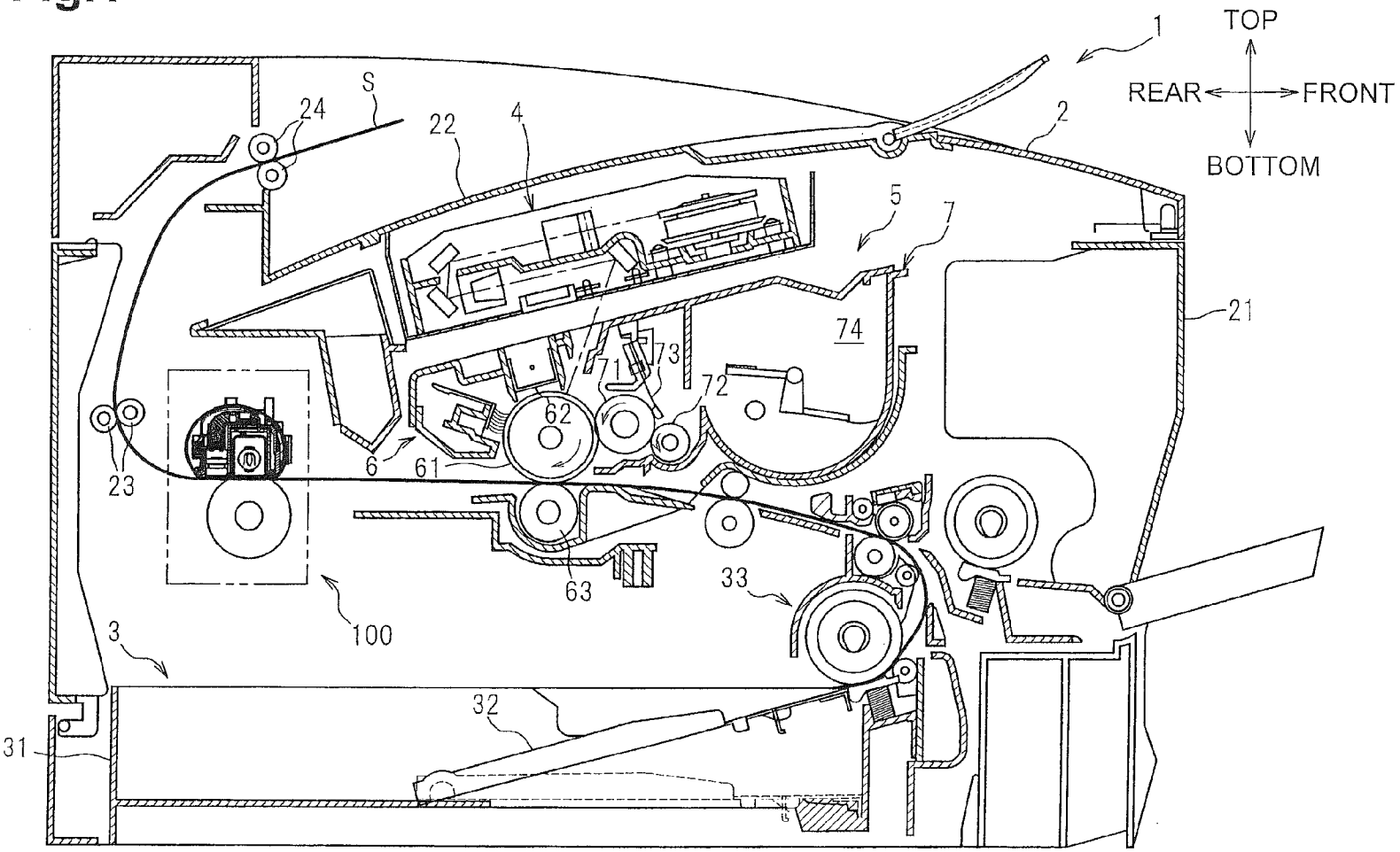
FIG. 1 illustrates a general configuration of an example laser printer including an example fixing device according to an embodiment.

As shown in FIG. 1, the laser printer 1 includes a feed portion 3 that feeds a sheet S as an example of a recording sheet, an exposure device 4, a process cartridge 5 that transfers a toner image (a developer image) on the sheet S, and the fixing device 100 that thermally fixes the toner image transferred on the sheet S. The feed portion 3, the exposure device 4, the process cartridge 5, and the fixing device 100 are arranged in a body housing 2.

The feed portion 3 is provided in a lower section of the body housing 2. The feed portion 3 includes a feed tray 31, a sheet push plate 32, and a feed mechanism 33. The sheet S housed in the feed tray 31 is lifted upward by the sheet push plate 32, and is fed by the feed mechanism 33 toward the process cartridge 5 (e.g., an area between a photosensitive drum 61 and a transfer roller 63).

The exposure device 4 is arranged in an upper section of the body housing 2. The exposure device 4 includes a laser light-emitting portion (not shown), a polygonal mirror (shown without a reference sign), a lens (shown without a reference sign), and a reflection mirror (shown without a reference sign). The exposure device 4 exposes the surface of the photosensitive drum 61 to light by scanning the surface of the photosensitive drum 61 at a high speed with laser light (see a dotted-chain line) emitted from the laser light-emitting portion based on image data.

The process cartridge 5 is arranged below the exposure device 4. The process cartridge 5 is removably mounted on the body housing 2 through an opening that appears when a front cover 21 provided at the body housing 2 is open. The process cartridge 5 includes a drum unit 6 and a developing unit 7.

The drum unit 6 mainly includes the photosensitive drum 61, a charging unit 62, and the transfer roller 63. The developing unit 7 is removably mounted on the drum unit 6. The developing unit 7 includes a developing roller 71, a feed roller 72, a layer-thickness regulation blade 73, and a toner container 74 that houses a toner (e.g., developer).

In the process cartridge 5, the charging unit 62 charges the surface of the photosensitive drum 61 uniformly with electricity and then the exposure device 4 exposes the surface of the photosensitive drum 61 to the laser light by high-speed scanning. Hence, an electrostatic latent image based on image data is formed on the photosensitive drum 61. The toner in the toner container 74 is fed to the developing roller 71 through the feed roller 72, thereby entering an area between the developing roller 71 and the layer-thickness regulation blade 73, and is held on the developing roller 71 as a thin layer with a constant thickness.

The toner held on the developing roller 71 is fed from the developing roller 71 to the electrostatic latent image formed on the photosensitive drum 61. Hence, the electrostatic latent image becomes a visible image, and a toner image is formed on the photosensitive drum 61. Then, when a sheet S is conveyed between the photosensitive drum 61 and the transfer roller 63, the toner image on the photosensitive drum 61 is transferred to the sheet S.

In the illustrative embodiment, the fixing device 100 is provided at the rear of the process cartridge 5. The toner image transferred onto the sheet S is thermally fixed to the sheet S when the sheet S passes through the fixing device 100. Then, the sheet S is output on an output tray 22 by convey rollers 23 and 24.

Figure 2:
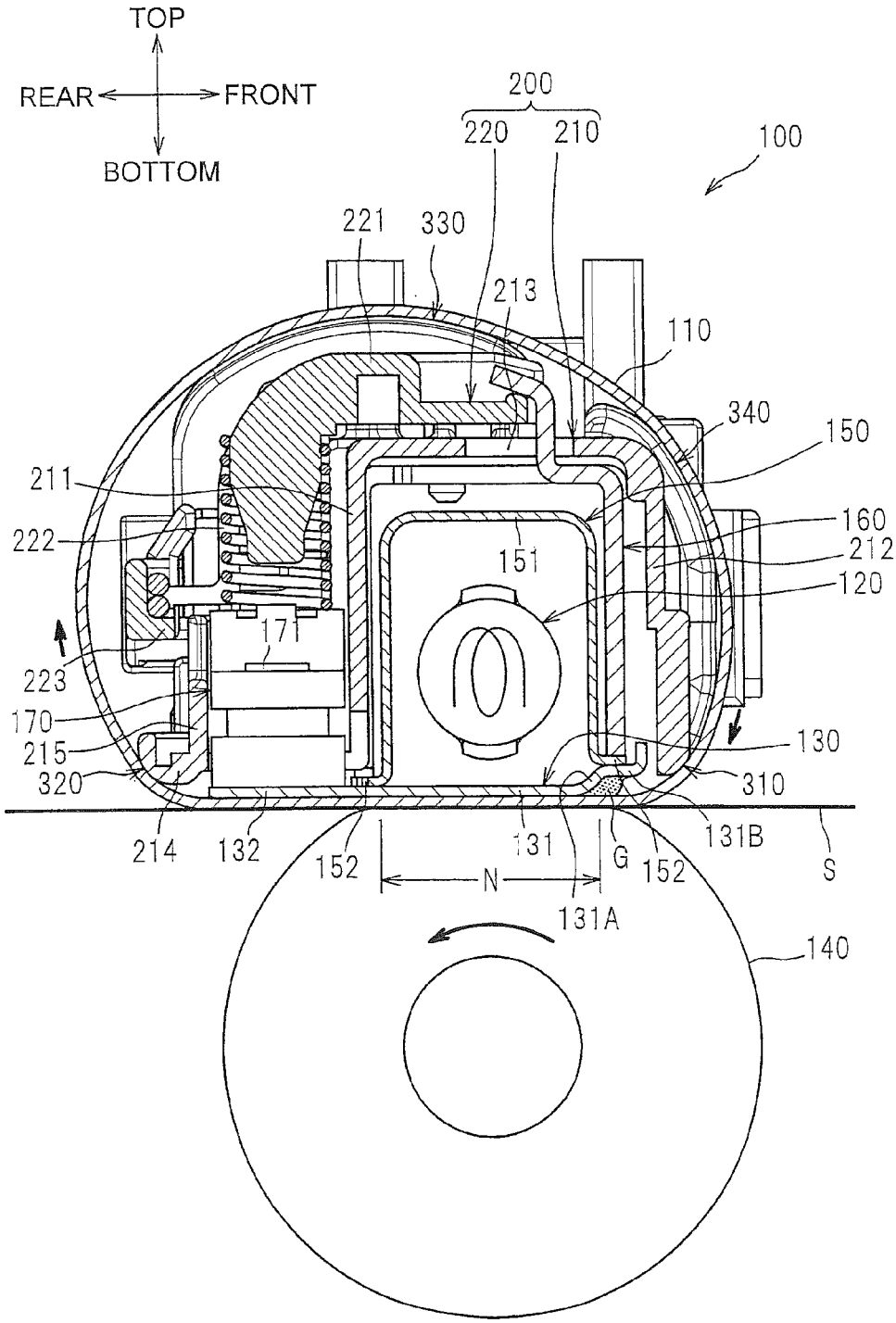
FIG. 2 is a cross-sectional view of the fixing device of FIG. 1.

Referring to FIG. 2, the fixing device 100 includes a fixing belt 110 as an example of a cylindrical member, a halogen lamp 120, a nip plate 130 as an example of a first fixing member, a pressure roller 140 as an example of a second fixing member (e.g., a backup member), a reflection member 150, and a stay 160.

The fixing belt 110 is an endless (cylindrical) belt that is made of stainless steel and that is heat resistant and flexible. The rotation of the fixing belt 110 is guided by a guide portion (e.g., a nip upstream guide 310, a nip downstream guide 320, an upper guide 330, and a front guide 340) that is formed at a cover member 200. The cover member 200 includes a first cover member 210 and a second cover member 220.

The first cover member 210 has a substantially U-like shape cross-section and extends in the left-right direction. The first cover member 210 covers the stay 160 at a side opposite to the halogen lamp 120 with respect to the stay 160. The first cover member 210 mainly includes a rear wall 211, a front wall 212, an upper wall 213 extending so as to connect the upper ends of the rear wall 211 and front wall 212 with each other, and an extension wall 214 extending rearward from the lower end of the rear wall 211.

The front guide 340 that guides a front section of the fixing belt 110 is formed near the right end of the front wall 212. The nip upstream guide 310 that guides a lower front section of the fixing belt 110 is formed at the lower end of the front wall 212. Also, the nip downstream guide 320 that guides a lower rear section of the fixing belt 110 is formed at the rear end of the extension wall 214.

The second cover member 220 has a substantially L-like shape cross-section and extends in the left-right direction. The second cover member 220 covers part of the rear wall 211 and part of the upper wall 213 of the first cover member 210. The second cover member 220 includes an upper wall 221, a rear wall 222 extending downward from the rear end of the upper wall 221, and an extension wall 223 extending rearward from the lower end of the rear wall 222. The upper guide 330 that guides an upper section of the fixing belt 110 is formed at the upper wall 221.

The halogen lamp 120 is a member that applies heat to the toner on the sheet S by generating radiant heat and applying the heat to the nip plate 130 and the fixing belt 110 (a nip portion N). The halogen lamp 120 is arranged inside the fixing belt 110 at predetermined distances from inner surfaces of the fixing belt 110 and the nip plate 130.

Figure 3:
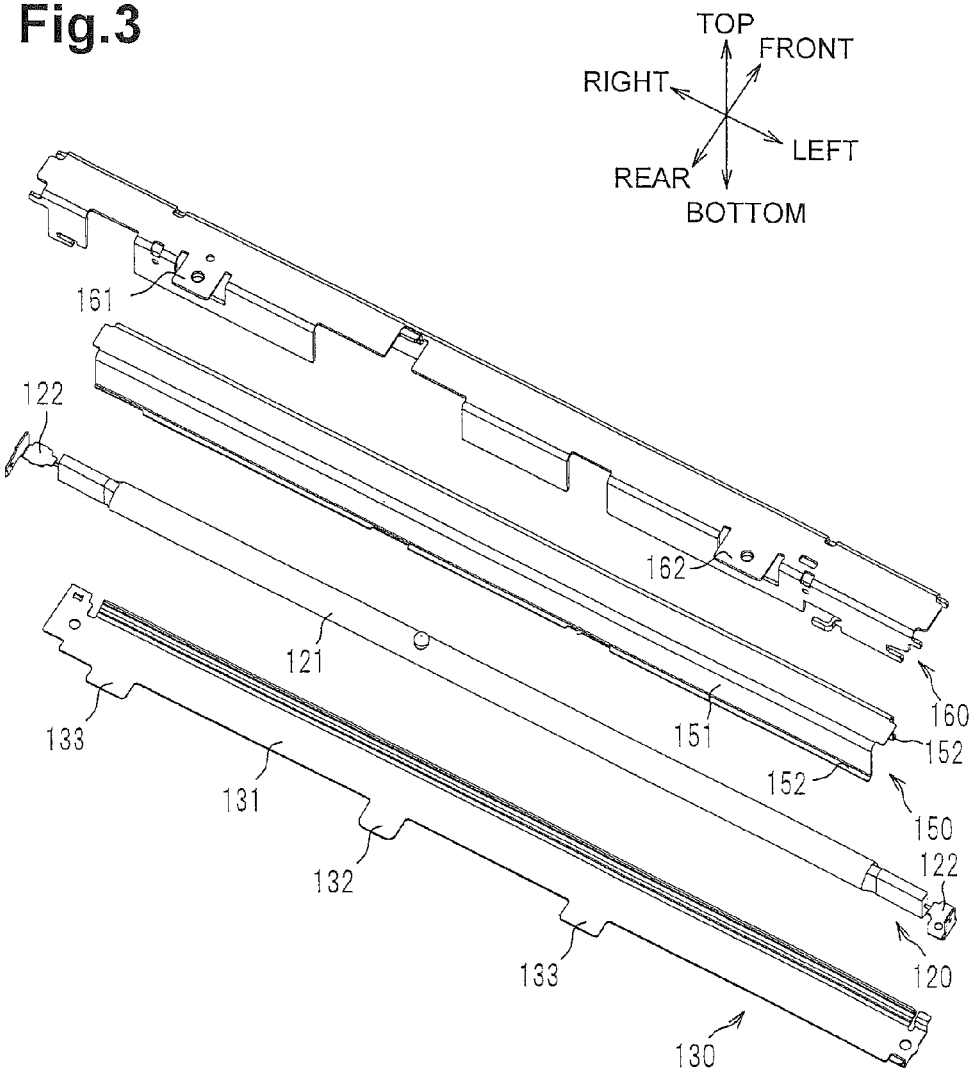
FIG. 3 is a perspective view showing a nip plate, a halogen lamp, a reflection member, and a stay.

Referring to FIG. 3, the halogen lamp 120 includes a filament (not shown) in a long cylindrical glass tube 121. Both ends in the longitudinal direction of the glass tube 121 are closed and inert-gas containing a halogen element is sealed in the glass tube 121. A pair of electrodes 122 are provided at both ends in the longitudinal direction of the halogen lamp 120. The pair of electrodes 122 are electrically connected with ends of the filament in the glass tube 121.

Referring back to FIG. 2, the nip plate 130 is a plate-like member that receives the radiant heat from the halogen lamp 120. The lower surface of the nip plate 130 slides on the inner peripheral surface of the fixing belt 110. In this embodiment, the nip plate 130 is made of metal, and is formed by bending a metal plate, for example, an aluminum plate having a higher thermal conductivity than the thermal conductivity of the stay 160 made of steel (described later). If the nip plate 130 is made of aluminum, the thermal conductivity of the nip plate 130 can be increased.

Referring to FIG. 3, the nip plate 130 includes a base portion 131, a first extension portion 132, and a second extension portion 133.

The base portion 131 slides on the inner peripheral surface of the fixing belt 110 and extends in a conveying direction of the sheet S to form the nip portion N. The base portion 131 transfers the heat from the halogen lamp 120 to the toner on the sheet S through the fixing belt 110. Referring to FIG. 2, a bending portion 131A is formed at an upstream end in the conveying direction of the base portion 131. The bending portion 131A bends to the inside (e.g., a side opposite to the pressure roller 140) of the fixing belt 110.

Accordingly, the fixing belt 110 can be prevented from wearing which may occur when the fixing belt 110 rubs against the edge of the nip plate 130.

Also, a flange portion 131B is formed at an upstream end in the conveying direction of the bending portion 131A. The flange portion 131B extends from the bending portion 131A to the upstream side in the conveying direction (e.g., to a side opposite to the base portion 131 in the conveying direction). Further, a lubricant G is provided at a corner between the bending portion 131A and the flange portion 131B. Accordingly, the lubricant G can further improve the sliding performance of the fixing belt 110.

Referring to FIG. 3, the first extension portion 132 and the second extension portion 133 are flat plates, and protrude rearward from the rear end of the base portion 131. For example, a single first extension portion 132 is formed at a position near the center in the left-right direction of the rear end of the base portion 131. A thermostat 170 (see FIG. 2) is arranged on the upper surface of the first extension portion 132 to face the first extension portion 132. Also, two second extension portions 133 are respectively formed at positions near the center and right end in the left-right direction of the rear end of the base portion 131. For example, one of second extension portions 133 is formed near the center while another of the second extension portions 133 is formed near the right end. Two thermistors (not shown) are respectively arranged on the upper surfaces of the second extension portions 133 to face the second extension portions 133.

Referring to FIG. 2, the pressure roller 140 is a member that forms the nip portion N between the pressure roller 140 and the fixing belt 110 by pinching the fixing belt 110 between the pressure roller 140 and the nip plate 130. The pressure roller 140 is arranged below the nip plate 130. In this embodiment, one of the nip plate 130 and the pressure roller 140 is urged to the other to form the nip portion N. Hence, the pressure roller 140 rotates while the pressure roller 140 and the nip plate 130 pinch the fixing belt 110, so that the pressure roller 140 and the fixing belt 110 convey the sheet S.

The pressure roller 140 is rotationally driven when a drive force is transmitted thereto from a motor (not shown) provided in the body housing 2. The fixing belt 110 is rotated by the rotation of the pressure roller 140 because of a friction force of the pressure roller 140 against the fixing belt 110 (or the sheet S). The sheet S with the toner image transferred thereon is conveyed through an area between the pressure roller 140 and the heated fixing belt 110 (the nip portion N). Accordingly, the toner image (the toner) is thermally fixed.

The reflection member 150 reflects the radiant heat from the halogen lamp 120 toward the nip plate 130. The reflection member 150 is arranged at a predetermined distance from the halogen lamp 120 so as to surround (cover) the halogen lamp 120 inside the fixing belt 110.

The reflection member 150 is formed by bending a material with a high reflectivity for infrared radiation or far-infrared radiation, for example, an aluminum plate, to have a substantially U-like cross-sectional shape. In one example, the reflection member 150 includes a reflection portion 151 having a curve shape, and flange portions 152 extending outward in the front-rear direction from both end portions in the front-rear direction of the reflection portion 151.

The stay 160 supports front and rear end portions of the nip plate 130 (the base portion 131) through the reflection member 150 (the flange portions 152), and hence receives a load from the pressure roller 140. The stay 160 is arranged inside the fixing belt 110 so as to cover the reflection member 150. In some arrangements, if the nip plate 130 urges the pressure roller 140, the load is a reactive force of the urging force applied by the nip plate 130 to the pressure roller 140.

The stay 160 is formed by bending a material with a relatively high rigidity, for example, a steel sheet to have a substantially U-like cross-sectional shape along the outer surface shape of the reflection member 150 (the reflection portion 151). Referring to FIG. 3, the stay 160 includes a right fixing portion 161 provided at the right and a left fixing portion 162 provided at the left. The right fixing portion 161 and the left fixing portion 162 extend rearward from an upper wall of the stay 160, and respectively have screw holes (illustrated without a reference sign) that penetrate through the right fixing portion 161 and the left fixing portion 162, respectively.

Figure 4:
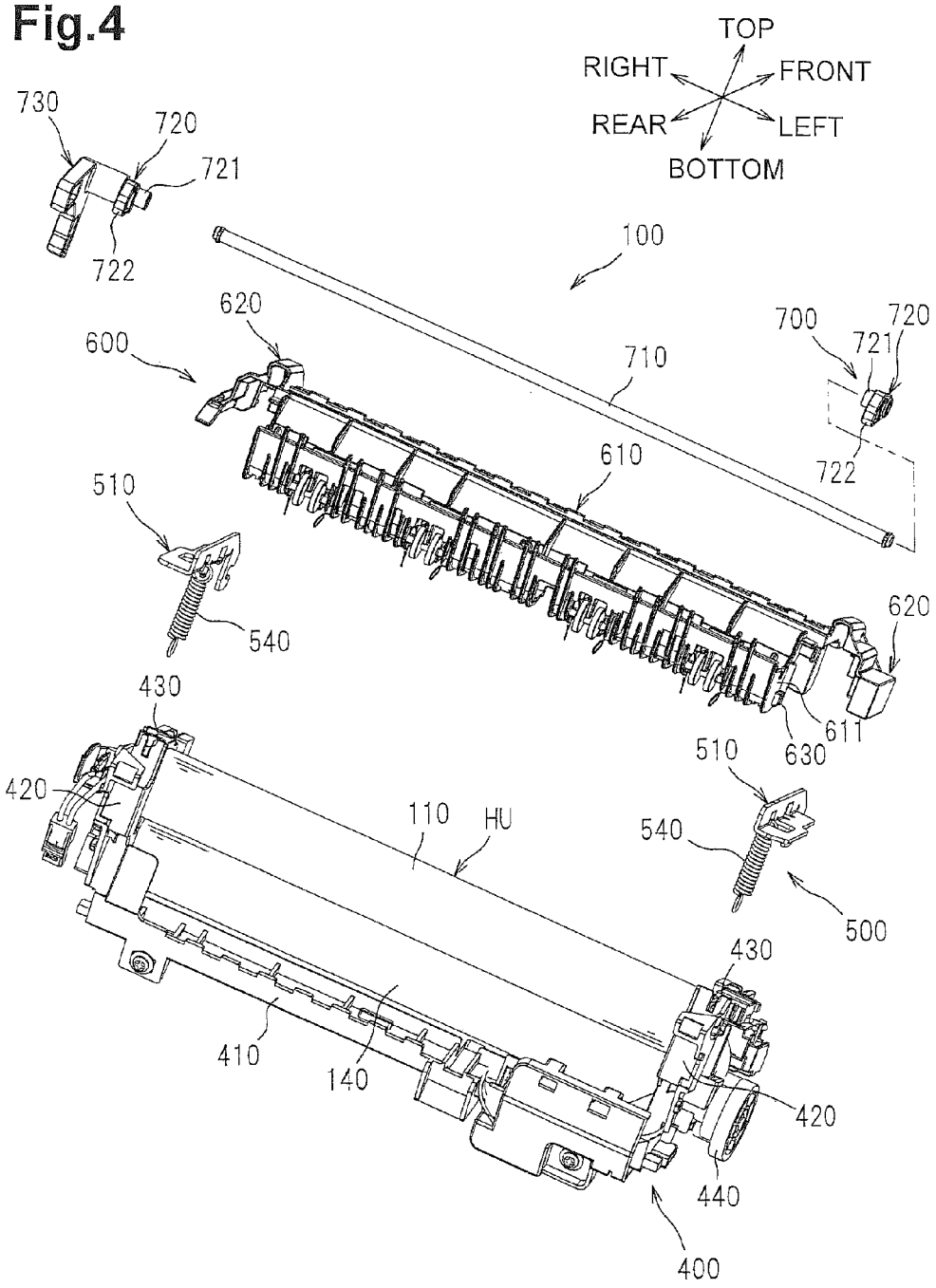
FIG. 4 is an exploded perspective view showing the fixing device in an exploded manner.

Referring to FIG. 4, the fixing device 100 includes a first frame 400, an urging mechanism 500, a second frame 600, and a change member 700, in addition to the above-described members.

The first frame 400 is a frame made of resin, in one example, and includes a lower wall 410 and a pair of side walls 420 that protrude upward from both ends in the left-right direction of the lower wall 410.

Lower portions of the pair of side walls 420 rotatably support the pressure roller 140, and upper portions of the side walls 420 support a heat unit HU slidably in the up-down direction. The heat unit HU includes a structure having the fixing belt 110, the halogen lamp 120, the nip plate 130, the reflection member 150, the stay 160, and the cover member 200. Also, the heat unit HU includes side guides (not shown) that support both the left and right ends of the structure (for example, the stay 160) and guide both the left and right ends of the fixing belt 110.

Since the side guides are slidably supported by the pair of side walls 420, the heat unit HU can move up and down. A drive gear 440 that drives the pressure roller 140 is provided at the left side wall 420.

In some examples, the drive gear 440 may be integrally provided at a left end portion of the pressure roller 140. The drive gear 440 rotates together with the pressure roller 140 when the drive gear 440 receives a drive force from a motor (not shown). Also, the urging mechanism 500 is provided at the pair of side walls 420.

The urging mechanism 500 is a mechanism that urges the heat unit HU (the nip plate 130) to the pressure roller 140. The urging mechanism 500 includes a pair of arm members 510 and a pair of extension springs 540 as an example of an urging member.

Figure 5A:
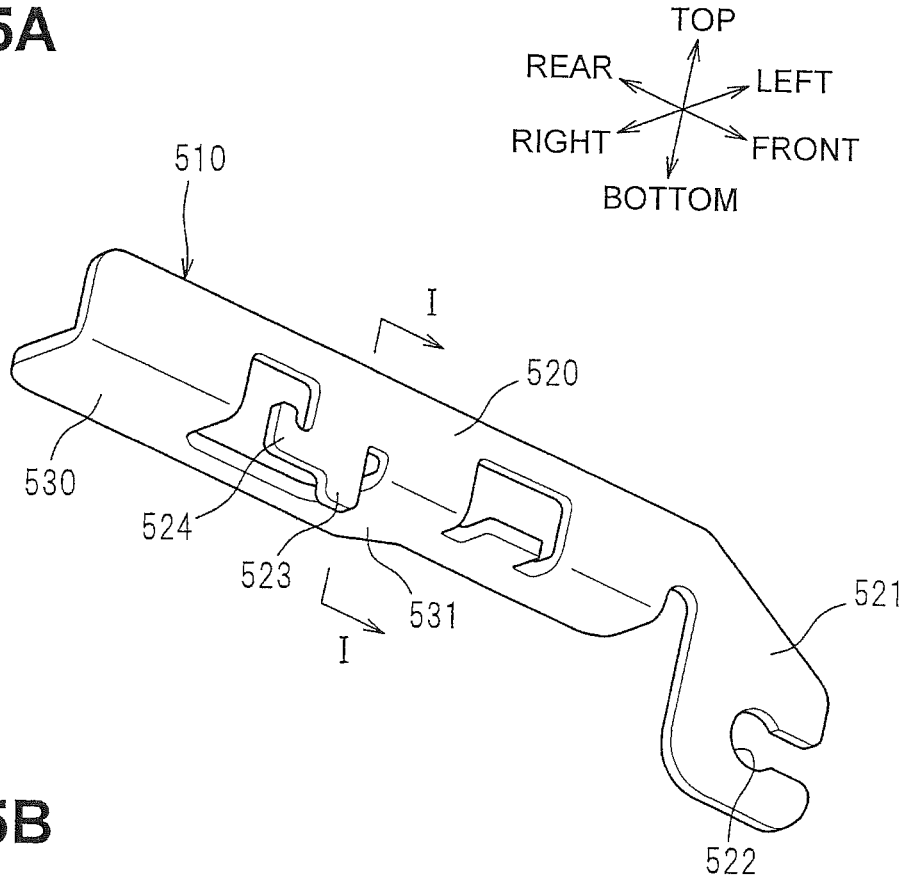
FIG. 5A is a perspective view showing an arm member.

The pair of arm members 510 are arranged above both the left and right ends of the heat unit HU, and have left-right symmetric shapes. Referring to FIG. 5A, each of the arm members 510 extends in the front-rear direction. The arm member 510 includes a plate-like vertical wall 520 and a plate-like lateral wall 530, and hence has an L-like shape cross-section.

The vertical wall 520 is a wall orthogonal to the left-right direction. A first extension portion 521 is formed at a front end portion of the vertical wall 520. The first extension portion 521 extends downward. The first extension portion 521 has a rotation center hole 522 that is rotatably supported at a shaft (not shown) formed at the corresponding side wall 420 of the first frame 400. Hence, a rear end portion of the arm member 510 is swingable around the rotation center hole 522.

Figure 5B:
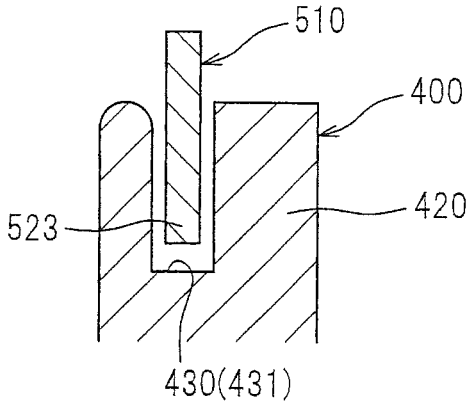
FIG. 5B is a schematic cross-sectional view showing the relationship between the arm member and a groove.

Also, a second extension portion 523 is formed at a rear portion of the vertical wall 520. The second extension portion 523 extends to protrude downward with respect to the lateral wall 530. Referring to FIGS. 4 and 5B, the second extension portion 523 enters a groove 430 that is formed at each of the side walls 420 of the first frame 400. The groove 430 is open to the upper side and has a bottom surface 431 as an example of a restriction portion. The bottom surface 431 faces the second extension portion 523 of the arm member 510 in the up-down direction (in an urging direction of the extension spring 540, which will be described later).

Accordingly, when the lower end of the second extension portion 523 comes into contact with the bottom surface 431 of the groove 430, the downward movement of the arm member 510 is restricted, and the heat unit HU is prevented from further moving downward.

Also, a hook 524 is formed at the side of the second extension portion 523. The hook 524 extends rearward and then bends upward. The extension spring 540 is provided between the hook 524 and the side wall 420 of the first frame 400. Hence, a rear end portion of the arm member 510 (e.g., a portion at a side opposite to the rotation axis with respect to a pressing portion 531 (described later) of the arm member 510) is urged to the first frame 400.

The lateral wall 530 is a wall orthogonal to the up-down direction. A substantially center portion of the lateral wall 530 serves as the pressing portion 531 that presses the heat unit HU. The pressing portion 531 is arranged at the outside of the hook 524 in the left-right direction. In other words, the extension spring 540 is arranged at the inside of the pressing portion 531 in the left-right direction (the inside in the width direction of the sheet S).

Accordingly, a force to the inside in the left-right direction is generated from the urging mechanism 500 to the pair of side walls 420 of the first frame 400.

The arm members 510 (e.g., the pressing portions 531 thereof) support the heat unit HU. The heat unit HU moves up and down in accordance with up-down movement of the arm members 510.

Referring to FIG. 4, the second frame 600 is a long frame made of resin extending in the left-right direction. The second frame 600 is arranged at a side opposite to the pressure roller 140 with respect to the heat unit HU. The second frame 600 extends between the pair of side walls 420 of the first frame 400. The second frame 600 includes a long body portion 610, and cover portions 620 that protrude to the outside in the left-right direction from upper front portions of left and right side surfaces 611 of the body portion 610.

The body portion 610 has a shorter length than the distance between the pair of side walls 420. The body portion 610 is arranged between the pair of side walls 420. Protrusions 630 are formed at lower rear portions of the left and right side surfaces 611 of the body portion 610. The protrusions 630 protrude to the outside in the left-right direction (e.g., outside in the width direction of the sheet S).

Figure 6A:
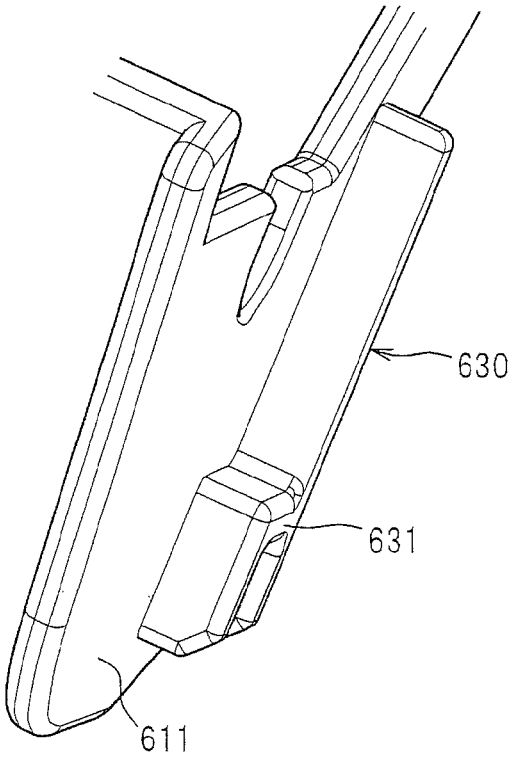
FIG. 6A is an enlarged perspective view showing a protrusion.

The protrusions 630 are arranged at the inside in the left-right direction of the side walls 420. Referring to FIG. 6A, the protrusions 630 have a height such that distal end surfaces 631 of the protrusions 630 are arranged at distances (e.g., spaced apart) from the pair of side walls 420. If the urging mechanism 500 pushes the pair of side walls 420 to the inside in the left-right direction and the side walls 420 bend, the side walls 420 come into contact with the distal end surfaces 631 and hence the side walls 420 can be prevented from being deformed. Accordingly, in this embodiment, the distal end surfaces 631 of the protrusions 630 serve as restriction surfaces that restrict the deformation of the side walls 420.

Since the deformation of the side walls 420 is restricted, the position of the drive gear 440 provided at the side wall 420 can be prevented from being shifted to the left or right. The drive gear 440 can be reliably operated. Also, since gaps are provided between the pair of side walls 420 and the distal end surfaces 631, the first frame 400 and the second frame 600 can be easily assembled with each other.

Figure 6B:
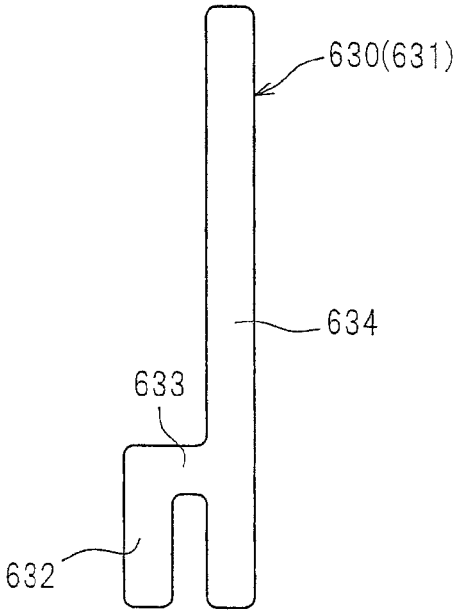
FIG. 6B is a side view of the protrusion.

Referring to FIG. 6B, each of the protrusions 630 includes a first plate 632, a second plate 633 orthogonal to (e.g., intersecting with) the first plate 632, and a third plate 634 orthogonal to the second plate 633. The plates 632 to 634 form an h-like shape. Hence, the rigidity of the protrusion 630 can be increased. The protrusion 630 can reliably restrict the deformation of the corresponding one of the pair of side walls 420. Since the plates 632 to 634 form the protrusion 630, e.g., since a thin structure forms the protrusion, the weight of the second frame 600 can be decreased.

Figure 7:
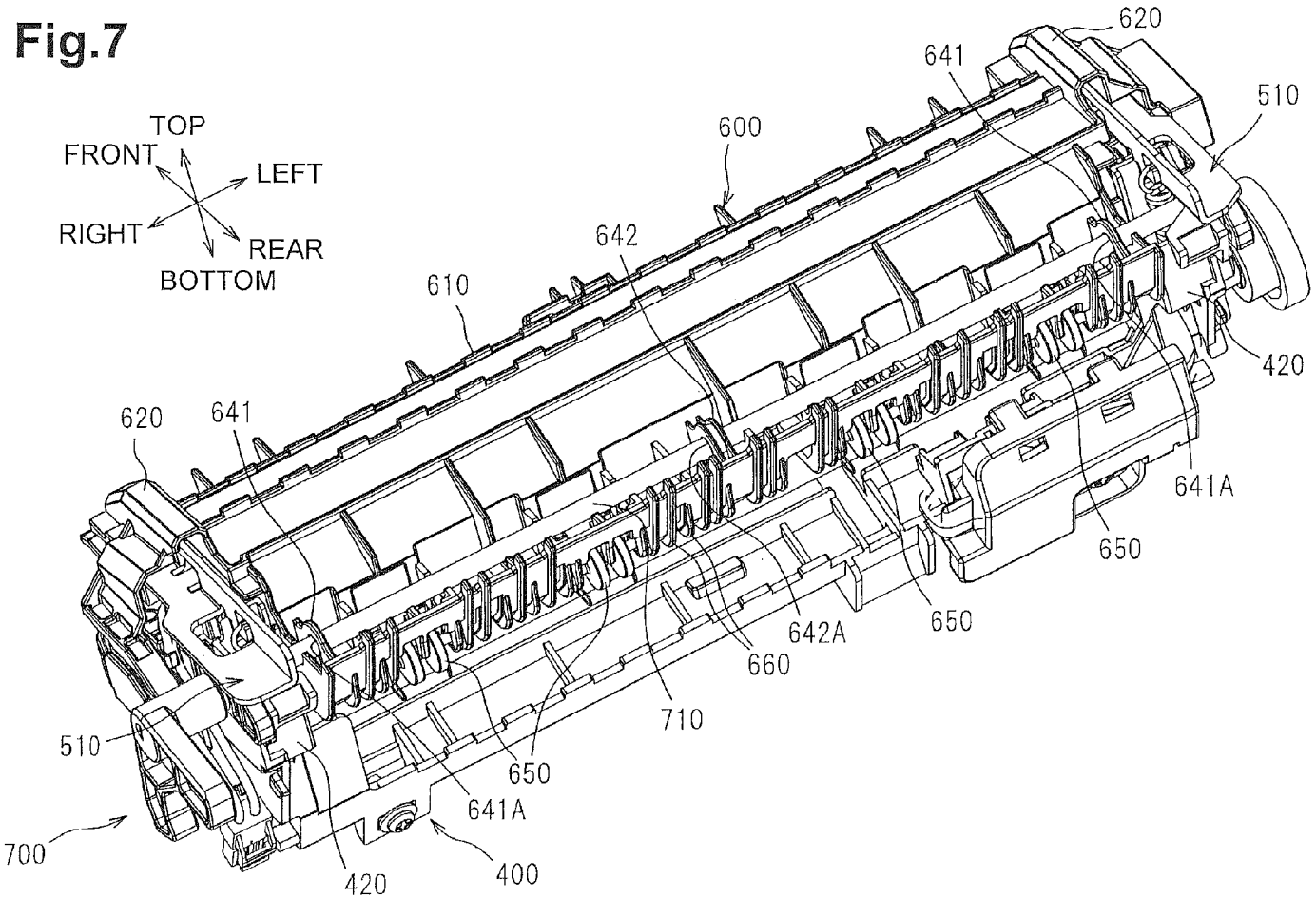
FIG. 7 is a perspective view showing the fixing device in view from a diagonally upper rear side.

Referring to FIG. 7, the first frame 400 and the second frame 600 are coupled to each other by a single shaft 710 of the change member 700 (described later). Accordingly, the first frame 400 and the second frame 600 can be accurately positioned with respect to the single shaft 710. Also, the number of parts can be decreased as compared with a structure in which a positioning shaft is provided in addition to the shaft 710 of the change member 700.

The shaft 710 extends from one end to the other end in the left-right direction of the second frame 600. The shaft 710 penetrates through the pair of side walls 420 of the first frame 400 and the second frame 600. Hence, the second frame 600 is reinforced by the shaft 710, and the second frame 600 is prevented from bending. The distal end surfaces 631 of the protrusions 630 can reliably restrict the deformation of the side walls 420. Also, since the second frame 600 is reinforced by the shaft 710 of the change member 700, the number of parts can be decreased as compared with a structure in which a reinforcing shaft is additionally provided.

In this example embodiment, the shaft 710 is made of metal. Hence, the rigidities of the resin frames 400 and 600 can be increased by the metal shaft 710 while the degree of freedom for the shapes of the two resin frames 400 and 600 is increased.

Three supported portions 641 and 642 are formed at the upper rear side of the second frame 600. The supported portions 641 and 642 are supported by the shaft 710. The two supported portions 641 from among the three supported portions 641 and 642 are provided at both end portions in the left-right direction (the axial direction of the shaft 710) of the second frame 600, and each are formed in a plate-like shape. For example, one of the supported portions 641 may be provided at one end portion while the other one of the support portions 641 may be provided at another end portion. The two supported portions 641 have through holes 641A. The shaft 710 is inserted through the through holes 641A.

The single supported portion 642 from among the three supported portions 641 and 642 is provided at an intermediate portion in the left-right direction of the second frame 600. Two plate-like ribs are coupled to each other at a coupling portion with a larger diameter than the diameter of the shaft 710. The supported portion 642 has a through hole 642A. The shaft 710 is inserted through the through hole 642A.

The intermediate portion of the second frame 600 may be a center portion in the left-right direction of the second frame 600 as illustrated, or may be at a position shifted to the left or right with respect to the center portion.

Since the three supported portions 641 and 642 are arranged as described above, the shaft 710 can reliably prevent the second frame 600 from bending. Also, the size of the coupling portion of the second frame 600 with respect to the shaft 710 can be minimized. Hence, the weight of the second frame 600 can be decreased.

Also, the left-right width of the supported portion 642 provided at the intermediate portion of the second frame 600 is larger than the left-right width of each of the supported portions 641 provided at both end portions. Hence, the intermediate portion of the second frame 600 can be reliably prevented from bending.

Figure 8A:
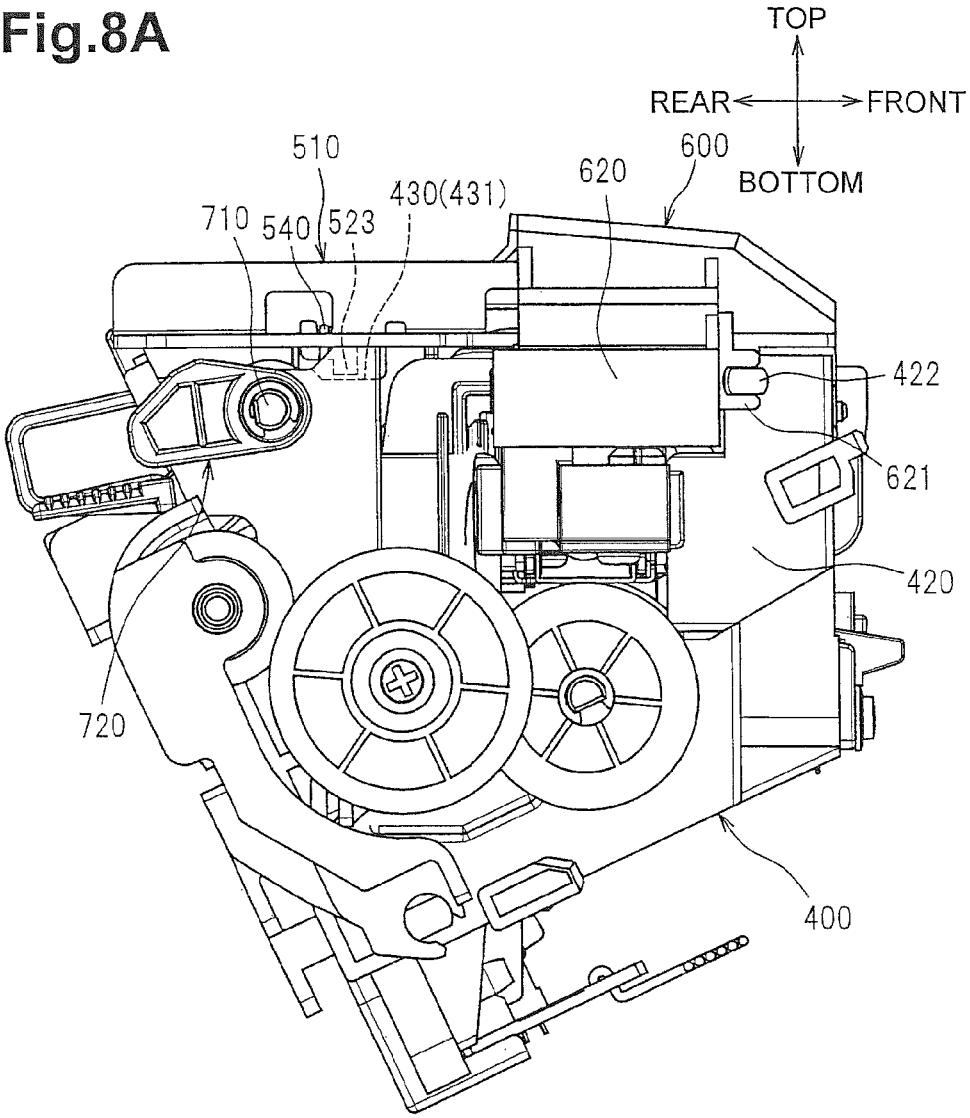
FIG. 8A is a side view showing the fixing device.
Figure 8B:
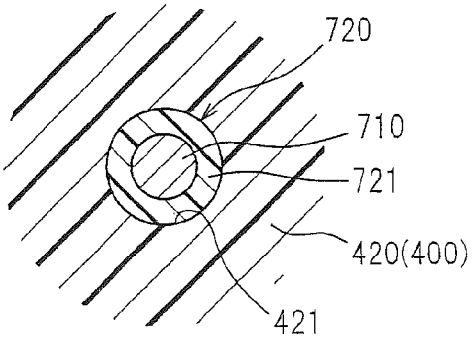
FIG. 8B is a schematic cross-sectional view when a side wall is cut at a position near a shaft.

Referring to FIGS. 8A and 8B, through holes 421 are formed at upper rear portions (at one side in the conveying direction of the sheet S) of the pair of side walls 420 of the first frame 400. The shaft 710 is inserted into the through holes 421. Since the shaft 710 penetrates through the rear portion of the first frame 400 and the rear portion of the second frame 600 in this way, the front portion of the second frame 600 becomes swingable around the shaft 710. This swing is restricted by protrusions 422 provided at the front portion of the first frame 400 and engagement recesses 621 provided at the front portion of the second frame 600.

In one example, the protrusions 422 are formed at the upper front portions (at the other side in the conveying direction of the sheet S) of the side walls 420 of the first frame 400 and protrude to the outside in the left-right direction.

The engagement recesses 621 are formed at the front side of the cover portions 620 of the second frame 600. Referring to FIG. 7, for example, the cover portions 620 may extend from both the left and right ends of the body portion 610 to the outside in the left-right direction, pass above the side walls 420, bend downward, and face the outer surfaces of the side walls 420. The cover portions 620 cover areas near the rotation axis of the arm members 510. Referring to FIG. 8A, the engagement recesses 621 are formed at the front of parts of the cover portions 620, the parts which face the outer surfaces of the side walls 420.

The engagement recesses 621 are recesses that are open to the front and engage with the protrusions 422 to pinch the protrusions 422 in the up-down direction. When the first frame 400 and the second frame 600 are assembled with each other, first, the pair of cover portions 620 of the second frame 600 slide along the upper surfaces of the pair of side walls 420 of the first frame 400, so that the pair of engagement recesses 621 engage with the pair of protrusions 422.

Then, the shaft 710 is inserted into the through holes 421 of the first frame 400 and the through holes 641A and 642A of the second frame 600. Hence, the second frame 600 is assembled with the first frame 400. For example, cams 720 (described later) may be attached to both ends of the shaft 710 inserted into the through holes 641A and 642A. Hence, the second frame 600 is assembled with the first frame 400.

Referring to FIG. 7, a plurality of convey rollers 650 are provided at an upper rear portion of the second frame 600 with intervals in the left-right direction. The convey rollers 650 convey a sheet S. Also, a plurality of guide ribs 660 are provided at the upper rear portion of the second frame 600 at intervals in the left-right direction so that the convey rollers 650 are arranged between the guide ribs 660 in the left-right direction. The guide ribs 660 guide a sheet S.

Figure 9:
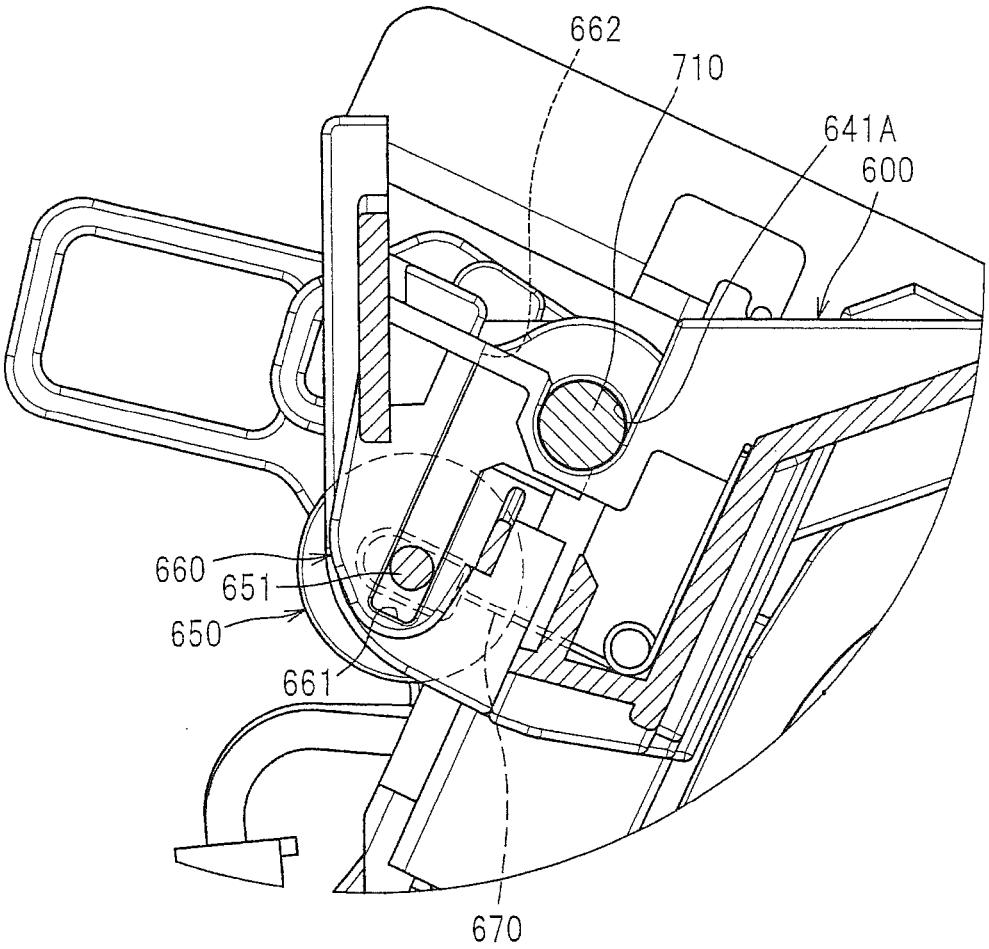
FIG. 9 is an enlarged cross-sectional view showing a structure around a convey roller.

Referring to FIG. 9, each of the guide ribs 660 arranged at both left and right sides of the convey rollers 650 has a substantially U-like groove-shaped bearing 661 that rotatably supports a rotation shaft 651 of the convey roller 650, and a guide groove 662 that guides the convey roller 650 to the bearing 661. The guide groove 662 extends from the bearing 661 to the upper surface (e.g., the outer surface) of the second frame 600. The guide groove 662 has a part near the upper surface, the part having a larger width than the width of the bearing 661. The guide groove 662 communicates with the space above the second frame 600.

Hence, the rotation shaft 651 of the convey roller 650 is easily inserted into the guide groove 662 (e.g., the large-width part). Also, when the rotation shaft 651 of the convey roller 650 is inserted along the guide groove 662, the rotation shaft 651 is guided to the bearing 661 by the guide groove 662, and the convey roller 650 can be assembled with the second frame 600.

After the convey roller 650 is assembled with the second frame 600, the shaft 710 is inserted into the through holes 421, 641A, and 642A of the frames 400 and 600. Hence, the shaft 710 is arranged on the locus of the convey roller 650 that moves along the guide groove 662. Accordingly, the shaft 710 can prevent the convey roller 650 from being detached from the second frame 600. The number of parts can be decreased as compared with a structure in which a member for preventing the convey roller 650 from being detached is provided in addition to the shaft 710.

Also, a torsion spring 670 is provided near the bearing 661 of the second frame 600. The torsion spring 670 urges the convey roller 650 to the bearing 661, and more particularly to the bottom surface of the U-like bearing 661. Hence, since the convey roller 650 is urged to a driving roller (not shown) arranged below the convey roller 650 by the torsion spring 670, the convey roller 650 can be driven by the driving roller.

Referring to FIG. 4, the change member 700 includes the shaft 710 and the pair of cams 720 that are fixed at (e.g., supported by) both end portions of the shaft 710. The shaft 710 is supported rotatably relative to the first frame 400 and the second frame 600. Thus, the pair of cams 720 provided at both end portions of the shaft 710 and the shaft 710 rotate relative to the frames 400 and 600.

The cams 720 are resin members that can adjust the width of the nip portion by pressing the arm members 510 upward against the urging force of the extension springs 540. The cams 720 are arranged below the arm members 510. Each of the cams 720 includes a cylindrical portion 721 through which the shaft 710 is inserted, and a plate cam portion 722 extending to the outside in the radial direction from the cylindrical portion 721.

The cylindrical portion 721 protrudes inward in the left-right direction (inward in the axial direction) from the plate cam portion 722. Referring to FIG. 8B, the cylindrical portion 721 is inserted into the through hole 421 of the side wall 420 of the first frame 400, and is rotatably supported at the through hole 421. Since the cylindrical portion 721 of the resin cam 720 slides relative to the resin first frame 400, the sliding resistance is decreased, and the cam 720 can be smoothly rotated.

Figure 10A:
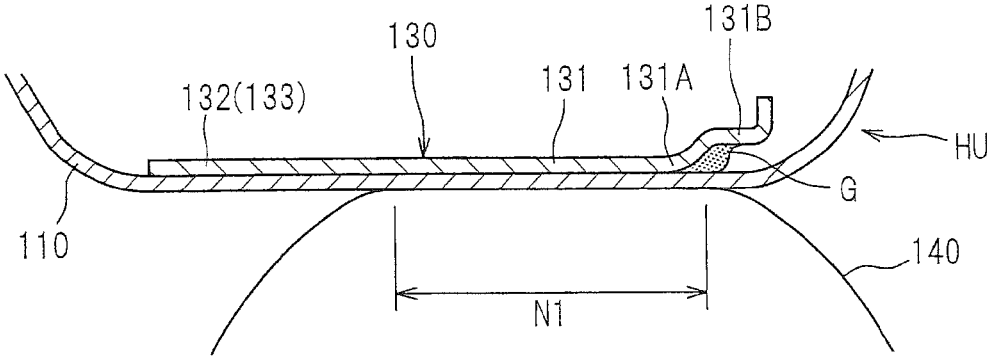
FIGS. 10A to 10C illustrate explanatory views showing states of a nip portion changed by a change member.
Figure 10B:
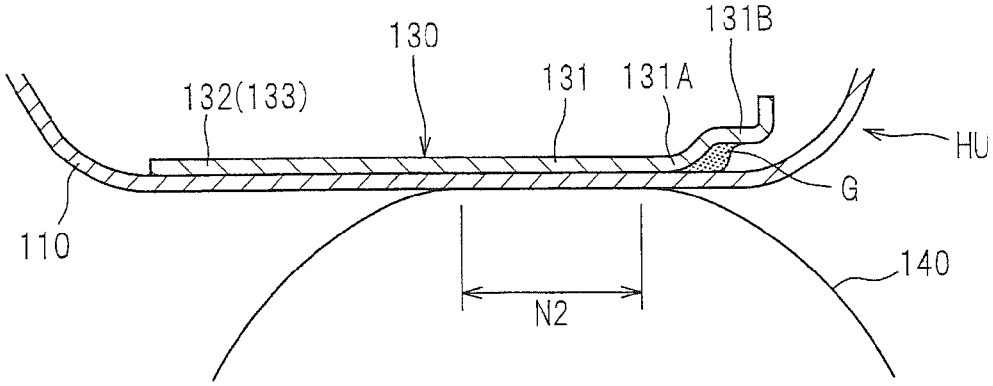
Figure 10C:
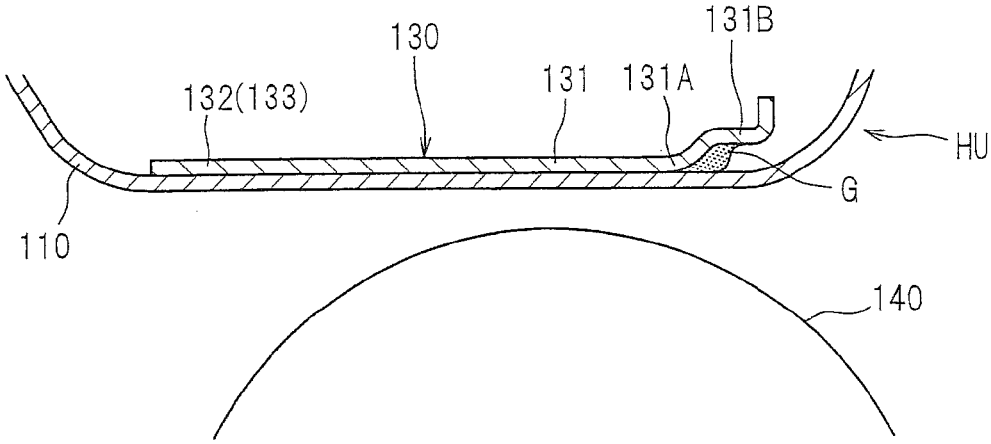

Referring to FIG. 4, an operation portion 730 is integrally formed at the outside in the left-right direction of the right cam 720. The operation portion 730 is operated by a user. When the user operates the operation portion 730, the nip width can be changed in three steps as shown in FIGS. 10A to 10C. FIG. 10A shows a first nip width N1 that is selected when printing is performed on normal paper or the like. FIG. 10B shows a second nip width N2 smaller than the first nip width N1, and the second nip width N2 is selected when printing is performed on thick paper or the like. FIG. 10C shows a state in which the heat unit HU is separated from the pressure roller 140 (nip width=0). In FIGS. 10A to 10C, the cover member 200 and other components are not illustrated for the convenience of description.

It is to be noted that the "first nip width N1" and the "second nip width N2" have certain ranges (tolerances) with respect to design values, and may be determined by experiments or simulations.

Figure 11A:
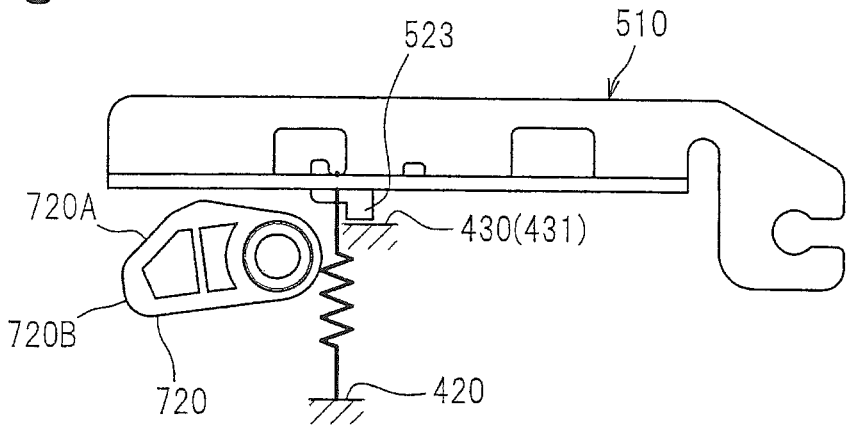
FIGS. 11A to 11C illustrate explanatory views showing the relationship between a cam and the arm member.
Figure 11B:
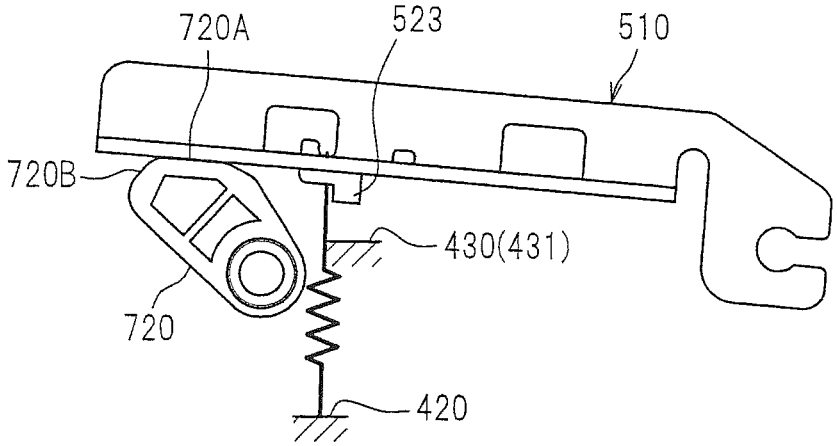

Specifically, in the state of the first nip width N1 shown in FIG. 10A, the cam 720 is separated from the arm member 510 (see FIG. 11A), and does not receive the urging force of the extension spring 540. When the cam 720 is rotated in one direction by an operation of the operation portion 730 as shown in FIG. 11B from the aforementioned state (hereinafter, referred to as "first direction"), and hence the direction of the cam 720 is changed from the first direction to a second direction, the cam 720 pushes up the arm member 510 by a predetermined amount. Accordingly, when a pressing force is applied to the heat unit HU against the urging force of the extension spring 540, the heat unit HU moves from a lowermost first position to an upper second position. Hence, as shown in FIG. 10B, the width of the nip portion is changed from the first nip width N1 to the second nip width N2.

Figure 11C:
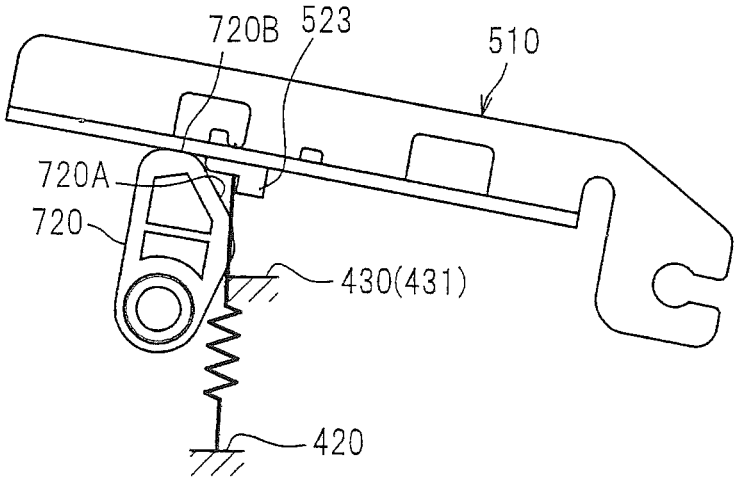

When the width of the nip portion is changed from the second nip width N2 to zero, the cam 720 is rotated in one direction by a predetermined amount by an operation of the operation portion 730, so that the direction of the cam 720 is changed from the second direction to a third direction as shown in FIG. 11C. Thus, the arm member 510 is further pushed up, the heat unit HU moves to an uppermost third position, and the nip width becomes zero (see FIG. 10C).

When the width of the nip portion is the second nip width N2 or zero, the cam 720 receives the urging force of the extension spring 540 through the arm member 510 as shown in FIGS. 11B and 11C. The direction of the cam 720, in the state in which the nip width is the second nip width N2 or in the separated state, is held such that a flat first release surface 720A or a complete release surface 720B formed at the cam 720 comes into surface-contact with the arm member 510.

When the width of the nip portion is changed from zero to the second nip width N2, the cam 720 is rotated in the other direction by a predetermined amount by an operation of the operation portion 730, so that the direction of the cam 720 is changed from the third direction to the second direction. Thus, the arm member 510 is moved downwardly by a predetermined amount by the urging force of the extension spring 540 (see FIG. 11B). Accordingly, the heat unit HU moves from the uppermost third position to the second position, and the width of the nip portion is changed from zero to the second nip width N2.

When the width of the nip portion is changed from the second nip width N2 to the first nip width N1, the cam 720 is rotated by a predetermined amount in the other direction by an operation of the operation portion 730, so that the direction of the cam 720 is changed from the second direction to the first direction. Thus, the pressing force applied from the cam 720 to the arm member 510 is released (see FIG. 11A). Accordingly, the heat unit HU moves from the second position to the lowermost first position, and the width of the nip portion is changed from the second nip width N2 to the first nip width N1.

Since the arm member 510 is not supported by the cam 720 when the width of the nip portion is the first nip width N1, if the pressure roller 140 becomes soft due to an environmental condition such as the temperature or humidity, the heat unit HU may move to a position lower than the first position, and the first nip width N1 may become larger than the maximum value of the allowable range. Owing to this, in this embodiment, the bottom surface 431 of the groove 430 is formed at a position corresponding to the maximum value of the first nip width N1.

Figure 12A:
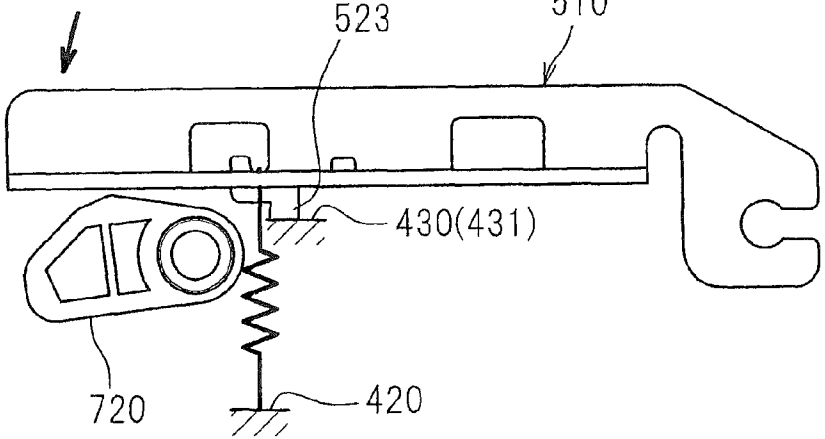
FIG. 12A is an explanatory view showing a state in which the arm member comes into contact with a bottom surface of the groove.
Figure 12B:
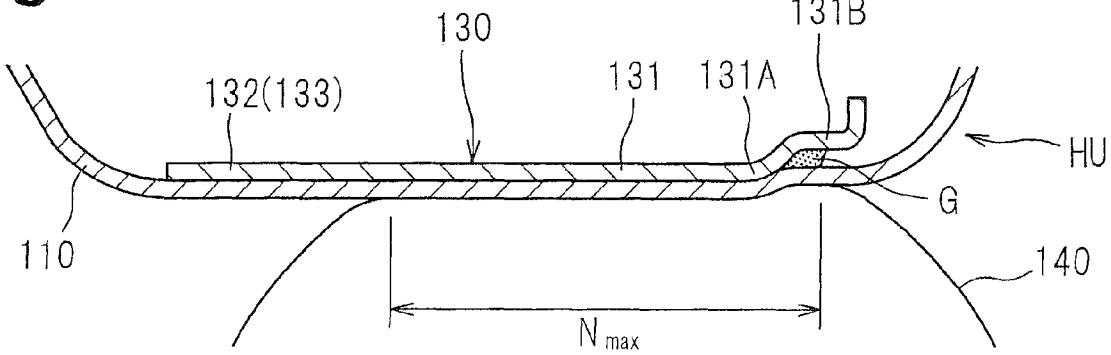
FIG. 12B is an explanatory view showing a state in which the width of the nip portion becomes the maximum value of a first nip width.

Accordingly, in the state in which the pressing force applied from the cam 720 to the arm member 510 is released, even if the pressure roller 140 becomes soft due to a change in environment and the heat unit HU is expected to move to a position lower than the first position, the arm member 510 comes into contact with the bottom surface 431 of the groove 430 as shown in FIG. 12A. The movement of the heat unit HU is restricted. Accordingly, as shown in FIG. 12B, the width of the nip portion can be prevented from becoming larger than a maximum value $N_{max}$ of the first nip width N1. As a result, proper fixing performance can be provided.

The bottom surface 431 of the groove 430 is provided at a position such that a gap is provided between the fixing belt 110 and the flange portion 131B of the nip plate 130 when the movement of the heat unit HU is restricted by the contact with the arm member 510 (see FIG. 12B). Accordingly, since the fixing belt 110 does not come into contact with the flange portion 131B, the lubricant G provided at the corner between the bending portion 131A and the flange portion 131B is prevented from being excessively conveyed by the fixing belt 110. Hence, the lubricant G can be reliably held at the corner, and the lubricant G can be used for a long period of time.

Also, the bottom surface 431 of the groove 430 is provided at a position such that the fixing belt 110 is not in contact with edge portions (e.g., edges) of the extension portions 132 and 133 when the movement of the heat unit HU is restricted by the contact with the arm member 510. For example, the movement of the arm member 510 and, more particularly, the movement of the heat unit HU may be stopped by the bottom surface 431 of the groove 430 so that the edge portions of the extension portions 132 and 133 do not enter the region of the nip portion. Accordingly, the fixing belt 110 can be prevented from being deteriorated, the deterioration which may occur when the fixing belt 110 slides on the edge portions of the extension portions 132 and 133.

Also, the change member 700 is configured such that the fixing belt 110 is not in contact with the bending portion 131A of the nip plate 130 when the width of the nip portion is the second nip width N2. For example, the change member 700 may be configured such that the bending portion 131A does not enter the region of the nip portion when the cam 720 supports the arm member 510 so that the width of the nip portion is the second nip width N2.

Accordingly, even when the fixing belt 110 comes into contact with the bending portion 131A when the nip width is the first nip width N1 (for example, when the nip width is the maximum value $N_{max}$ of the first nip width N1 as shown in FIG. 12B), the fixing belt 110 does not come into contact with the bending portion 131A when the nip width is the second nip width N2. The fixing belt 110 can be prevented from being deteriorated when the nip width is the second nip width N2.

The fixing device is not limited to the above-described embodiment. The configuration of the above-described embodiment may be appropriately modified within the scope of the disclosure.

In the above-described embodiment, the restriction portion (the bottom surface 431 of the groove 430) is provided at a position such that a gap is provided between the fixing belt 110 and the flange portion 131B of the nip plate 130. In other examples, however, the restriction portion may be provided at a position (e.g., the position shown in FIG. 10A) such that the cylindrical member is not in contact with the bending portion when the restriction portion restricts the movement of the first fixing member.

Accordingly, the cylindrical member can be prevented from being deteriorated, the deterioration which may occur when the cylindrical member is deformed along the bending portion.

Additionally or alternatively, the above-described embodiment provides that the restriction portion may employ the bottom surface 431 of the groove 430 that comes into contact with the arm member 510. However, in other arrangements, the regulation portion may be a protrusion that comes into contact with the nip plate.

Moreover, in the above-described embodiment, the first fixing member is the nip plate 130, and the second fixing member is the pressure roller 140. However, in some examples, the first fixing member may be the pressure roller, and the second fixing member may be the nip plate. In still other examples, the first fixing member may be the heat roller, and the second fixing member may be the pressure roller.

In the above-described embodiment, the pressure roller 140 serves as the backup member. However, a belt-like pressure member may also be used.

In the above-described embodiment, the urging mechanism 500 is formed of the arm member 510 and the extension spring 540. In other examples, the urging mechanism 500 may be formed of an arm member and a torsion spring, or may be formed of only an urging member such as an extension spring or a torsion spring.

Figure 13:
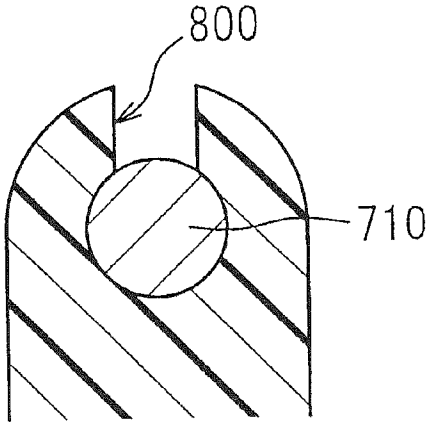
FIG. 13 is a cross-sectional view showing a modification of a portion that supports the shaft.

In the above-described embodiment, the shaft 710 is supported at the through hole 641A and the like. However, other examples, e.g., as shown in FIG. 13, may include a notch 800 that is a hole with part of the outer periphery thereof being open to the outside may support the shaft 710.

In the above-described embodiment, the fixing belt 110 (the cylindrical member) is made of stainless steel. Alternatively or additionally, the fixing belt 110 may be formed of another metal, resin such as polyimide resin, or an elastic material such as rubber. If the fixing belt 110 is made of resin, the sliding resistance of the fixing belt 110 with respect to the nip plate 130 made of metal can be decreased. The sliding performance of the fixing belt 110 can be further improved.

Also, the cylindrical member may have a multilayer structure. For example, a resin layer for decreasing the sliding resistance may be provided on the surface of the metal belt, or an elastic layer such as a rubber layer may be provided on the surface of the metal belt.

In the above-described embodiment, the upstream end portion in the conveying direction of the nip plate 130 warps to the inside of the fixing belt 110. However, in other examples, the downstream end portion in the conveying direction may warp.

In the above-described embodiment, the sheet S, such as normal paper or a post card, serves as the recording sheet. However, an OHP sheet (a transparency film used for an overhead projector) may also be used.

In the above-described embodiment, the laser printer 1 that forms a monochrome image serves as the image forming apparatus including a fixing device. However, the aspects described herein may also be used or implemented in a printer that forms a color image may be used. Also, the image forming apparatus is not limited to printers, and may be, for example, a copier or a multi-function apparatus including a document reading device such as a flat bet scanner.

What is claimed is:

1. A fixing device comprising:

a flexible cylindrical member;

a first fixing member, wherein the first fixing member is a nip plate, and an inner peripheral surface of the flexible cylindrical member is configured to slide on the nip plate, wherein the nip plate comprises:

a base portion that forms a nip portion, a bending portion bending from the base portion to a side opposite to a backup member, a flange portion extending from the bending portion to a side opposite to the base portion in a conveying direction of a recording sheet, wherein a lubricant is provided at a corner between the bending portion and the flange portion, and an extension portion having an edge, the extension portion extending from the base portion in the conveying direction;

a second fixing member, wherein the second fixing member is the backup member, wherein the backup member and the nip plate are configured to pinch the flexible cylindrical member and form the nip portion;

an urging mechanism comprising an urging member configured to urge the first fixing member toward the second fixing member by an urging force;

a change member configured to change a width of the nip portion between a first nip width and a second nip width that is smaller than the first nip width by applying and releasing a pressing force to the first fixing member against the urging force of the urging member; and a restriction portion configured to restrict movement of the first fixing member and to restrict a maximum value of the first nip width of the nip portion while the pressing force against the urging force is released, wherein the restriction portion is provided at a position such that the flexible cylindrical member is not in contact with the edge of the extension portion when the movement of the first fixing member is restricted.

2. The fixing device according to claim 1, wherein the restriction portion is provided at a position such that a gap is provided between the flexible cylindrical member and the flange portion when the movement of the first fixing member is restricted.

3. The fixing device according to claim 1, wherein the restriction portion is provided at a position where the flexible cylindrical member is not in contact with the bending portion when the movement of the first fixing member is restricted.

4. The fixing device according to claim 1, wherein the change member is configured such that the flexible cylindrical member is not in contact with the bending portion when the width of the nip portion is the second nip width.

5. The fixing device according to claim 1, wherein the fixing device comprises a frame, wherein the urging mechanism comprises an arm member rotatably supported at the frame and configured to press the first fixing member, and wherein the arm member is urged to the frame by the urging member.

6. The fixing device according to claim 5, wherein the restriction portion is a surface of the frame, wherein the surface faces the arm member in an urging direction of the urging member, and the restriction portion is configured to restrict the movement of the first fixing member by contacting the arm member.

7. The fixing device according to claim 5, wherein the change member comprises a cam configured to adjust the width of the nip portion by pressing the arm member against the urging force of the urging member.

* * * * *